US007777115B2

(12) United States Patent
Komatsu et al.

(10) Patent No.: US 7,777,115 B2
(45) Date of Patent: Aug. 17, 2010

(54) KEYBOARD MUSICAL INSTRUMENT

(75) Inventors: Akihiko Komatsu, Hamamatsu (JP); Nariyasu Yaguchi, Hamamatsu (JP)

(73) Assignee: Yamaha Corporation, Hamamtsu-Shi (JP)

( * ) Notice: Subject to any disclaimer, the term of this patent is extended or adjusted under 35 U.S.C. 154(b) by 0 days.

(21) Appl. No.: 11/959,407

(22) Filed: Dec. 18, 2007

(65) Prior Publication Data

US 2008/0141847 A1 Jun. 19, 2008

(30) Foreign Application Priority Data

Dec. 19, 2006 (JP) ..... 2006-341432

(51) Int. Cl.
*G10C 3/12* (2006.01)

(52) U.S. Cl. ..... 84/423 R; 84/615

(58) Field of Classification Search ..... 84/423 R, 84/615

See application file for complete search history.

(56) References Cited

U.S. PATENT DOCUMENTS

| | | | | |
|---|---|---|---|---|
| 5,767,842 | A * | 6/1998 | Korth | 345/168 |
| 5,922,983 | A | 7/1999 | Muramatsu | |
| 6,376,759 | B1 * | 4/2002 | Suzuki | 84/615 |

FOREIGN PATENT DOCUMENTS

| | | |
|---|---|---|
| JP | 04-057093 | 2/1992 |
| JP | 05-011765 | 1/1993 |
| JP | 3772491 | 2/2006 |

* cited by examiner

*Primary Examiner*—Jianchun Qin
(74) *Attorney, Agent, or Firm*—Morrison & Foerster LLP

(57) ABSTRACT

An approach of a finger of a player to a key in order to conduct an operation for playing music is sensed to exert an external force which resists a depression of the key before the finger whose approach has been sensed touches the key. As a result, the touch feeling of keys of an acoustic piano perceived by a player right after depressions of the keys is realized.

14 Claims, 7 Drawing Sheets

(before touch of finger on key)

(after touch of finger on key)

KEYBOARD MUSICAL INSTRUMENT

BACKGROUND OF THE INVENTION

1. Field of the Invention

The present invention relates to a keyboard musical instrument.

2. Description of the Related Art

Conventionally, there have been electronic pianos having a simple action mechanism which uses springs or weights in order to bring the key touch of the electronic pianos close to that of an acoustic piano. Furthermore, there have been known arts for realizing the key touch of an acoustic piano not by providing the simple action mechanism but by sensing a velocity and a force of a depression of a key to exert an external force on the key from under the key by use of an actuator (e.g., Japanese Patent Publication No. 3772491, Japanese Examined Patent Publication No. 07-111631 and Japanese Patent Publication No. 3191327).

In acoustic pianos, the thickness of strings varies according to pitch, while the size and the mass of hammers also vary according to pitch. In general, bass keys have hammers having heavier mass to strike thicker strings, resulting in heavier touch of the keys. On the other hand, the touch of treble keys is lighter. When a case where a key is played fortissimo is compared with a case where the key is played pianissimo, the case where the key is played fortissimo provides a player with heavier touch of the key.

DISCLOSURE OF THE INVENTION

Problems to be Solved by the Invention

The conventional arts sense a position of a key, a key velocity, a key acceleration, a force exerted on the key, and the like after a depression of the key with a finger of a player to exert an external force on the key from under the key in accordance with the sensed physical quantities. In cases where the conventional arts are employed, more specifically, the physical quantities are sensed, after a player starts depressing a key, to derive an external force to be exerted on the key in accordance with the physical quantities to drive an actuator. Therefore, the conventional arts cause a delay in actually exerting the external force on the key after the player starts depressing the key. Until the external force is exerted after the start of the depression of the key, the touch of the key provided in the case where the key is played fortissimo is the same as that provided in the case where the key is played pianissimo. As a result, the conventional arts cause a problem that skilled players recognize the key touch perceived just after the depression of keys as strange.

The present invention was accomplished to solve the above-described problem, and an object thereof is to provide an art for realizing the touch of keys of an acoustic piano, the touch being perceived by a player right after the player has depressed the keys.

Means for Solving Problems and Technical Effect

In order to achieve the above-described object, the present invention employs a configuration which senses an approach of a finger of a player to a key and exerts an external force on the key before the sensed finger touches the key. In this configuration, the external force has already been exerted on the key at least at the point in time when the player starts depressing the key. As a result, the player perceives the touch of the key which is close to that of an acoustic piano as soon as the player depresses the key of the keyboard musical instrument. The configuration which exerts an external force on a key before a finger touches the key may include an instant when the finger touches the key.

In the present invention, an approach sensing portion senses various physical quantities relating to an approach of a finger of a player. The physical quantities relating to an approach of a finger include a distance between a finger and a key, a velocity at which a finger approaches a key, and an acceleration of the velocity, for example. Objects to be sensed directly are not limited to those cited above. For instance, physical quantities such as position and acceleration may be sensed to derive a velocity in accordance with the sensed physical quantities.

The physical quantities relating to an approach of a finger can be sensed by sensing undulations emitted by a finger itself, undulations reflected by the finger, or undulations cut off by the finger, for example. For instance, the physical quantities can be sensed by sensing capacitance between objects. The undulations intended in the present invention are electromagnetic wave, ultrasound and the like. The wavelength and frequency of electromagnetic wave are not limited particularly. Various kinds of electromagnetic waves from long-wavelength to short-wavelength and various kinds of lights such as infrared light and visible light can be adopted. Of course, the wavelength and frequency can be determined according to the range in which an approach of a finger is allowed to be sensed. The position where a sensor is placed may be either inside a key or outside a key. Furthermore, a configuration in which a mechanism for sensing is provided both inside and outside the key may be employed. In some methods of sensing or properties of a sensor, the sensor may be exposed on the surface of a key.

As examples of the configuration in which the sensor is provided outside a key may include a configuration in which an image sensor is provided at a position from which a finger approaching a key can be shot to derive an approach velocity of the finger by analysis of images and comparison of the analyzed results among frames. As examples of the configuration in which the sensor is provided inside a key may include a configuration in which a reflective photosensor having an infrared light emitting portion and an infrared light receiving portion is provided inside a key to derive an approach velocity of a finger in accordance with infrared light emitted by the infrared light emitting portion, reflected by the finger and then received by the infrared light receiving portion. Furthermore, a configuration in which a capacitance sensor is provided on the surface of a key to derive an approach velocity of a finger in accordance with a capacitance between a probe of the capacitance sensor and the finger may be employed. In addition, a thermal sensor or a Doppler sensor using the Doppler effect may be employed. Examples of a configuration in which a sensing mechanism is provided both inside and outside a key may include a configuration in which a light emitting element such as infrared light is provided either outside or inside a key while a light receiving element is provided on the other side of the key. In this configuration, these elements are arranged such that an area within which a finger moves to depress the key is included in a path along which light runs from the light emitting element to the light receiving element. In this configuration, furthermore, an approach velocity of the finger may be derived in accordance with the amount of light varied by the finger cutting off the light emitted by the light emitting element.

In the respective configurations described above, furthermore, a key may have a plurality of sensors arranged in parallel with a surface of the key, the surface being to be depressed by a player. Because the player does not always depresses the same position of the key, the plurality of sensors are arranged to sense an approach of a finger regardless of where the key is depressed. If it is difficult to arrange the plurality of sensors in parallel with the surface of the key, it is preferable to provide the sensor within an area where the player is most likely to depress. In a case where the capacitance sensor is employed, if the probe of the sensor which covers an area as large as possible in a range of the surface of the key where a player is supposed to depress is employed, the number of the sensors may be one.

A sensor of approach sensing portion may be provided either for each key or for a plurality of keys according to method of sensing or type of undulations to sense. The latter example includes a configuration which employs an image sensor. In this case, analysis of sensed image allows identification of a key which a finger approaches. The case in which a sensor is provided for a plurality of keys can reduce the number of parts which compose the embodiment, compared to a case where the image sensor is provided for each key.

For an external force exerting portion, various kinds of actuators can be employed which exert, on a key, an external force which resists a depression of the key. Examples may include a configuration in which a plunger solenoid is provided under each key.

In the present invention, a controlling portion makes the external force exerting portion exert an external force on a key before a finger whose approach has been sensed touches the key. For instance, the controlling portion may allow the external force exerting portion to exert the external force if it is sensed that the finger is at a certain distance from the key. The magnitude of the external force may be a fixed value. In a case where an approach velocity of a finger is sensed, for example, the controlling portion may allow exertion of an external force corresponding to the sensed approach velocity. In a case where it is sensed that a finger is at a certain distance from a key, the controlling portion may allow exertion of an external force corresponding to the mass of the finger.

In the present invention, furthermore, the controlling portion may specify the magnitude of an external force to be exerted on a key in accordance with an approach velocity of a finger and the mass of the finger. More specifically, the magnitude of an external force to be exerted on a key can be considered as a physical quantity which has a correlation between the approach velocity of the finger and the mass of the finger. As the physical quantity equivalent to the mass of a finger, a predetermined value may be used. Examples of the physical quantity having a correlation between the approach velocity of a finger and the mass of the finger include momentum, impulse, force and kinetic energy. The controlling portion may increase the magnitude of an external force with increasing approach velocity of a finger. The relationship between an approach velocity and the magnitude of an external force may be either linear or non-linear. The controlling portion may increase the magnitude of an external force with increasing mass of a finger. In this case, the relationship between the mass of a finger and the magnitude of an external force may be either linear or non-linear. By controlling the magnitude of an external force in accordance with an approach velocity of a finger and the mass of the finger, the present invention makes the touch of the keys close to that of the keys of an acoustic piano.

The magnitude of an external force to be specified by the controlling portion may vary according to the kind of a key or the pitch of the key. For example, an external force to be exerted on a black key may be smaller than an external force to be exerted on its neighboring white keys. For instance, in addition, external forces to be exerted on treble keys may be smaller than external forces to be exerted on bass keys. The magnitude of an external force may vary from pitch to pitch. For example, the magnitude of an external force may vary among octaves.

Furthermore, the controlling portion may allow the external force exerting portion to exert an external force on a key if a distance between a finger of a player and the key is a certain distance or less. This case saves power consumption compared to a case where an external force is generated even in a state where a distance between a finger and a key is the certain distance or more.

In addition, the present invention may also have an inputting portion for inputting a parameter corresponding to the mass of a finger. For instance, the inputting portion may have a dial which allows a player to choose his desired degree of key touch from among a few levels from "heavy" to "light". In this example, in a case where a child is a player, the player may be allowed to choose "light", while in a case where an adult is a player, the player may be allowed to choose "heavy". In general, the mass of a child's finger is lighter than that of adult's finger. When "light" is chosen, in spite of depressions of a key with the same velocity, the controlling portion specifies a weaker external force than that specified in a case where "heavy" is chosen. As described above, the present invention allows control of the magnitude of external forces, so that the player is allowed to make subtle adjustments to realizing the touch of an acoustic piano.

In addition, the present invention may also have a key position sensing portion for sensing a position of a key. In this configuration, the controlling portion may allow exertion of the external force specified in accordance with the position of the key after a finger has touched the key. As the key position sensing portion, various configurations may be employed as long as these configurations are capable of sensing variations of the position of a depressed key. For instance, a plunger solenoid may be provided under the key to sense the position of the key in accordance with voltage varying according to moves of the plunger. As another example, the position of the key may be sensed in a manner in which light is applied in the vicinity of an edge of the plunger to sense the position of the key by using variations of the amount of light cut off by the plunger according to the move of the plunger.

As the present invention, the technique of deriving a velocity at which a finger of a player approaches a key and exerting an external force which resists a depression of the key on the key before the finger touches the key can be applied to a program which achieves this technique. Furthermore, the technique may be achieved in various ways such as achieving part of the technique by software while achieving the other part of the technique by hardware. Furthermore, the present invention can be considered as an invention of a storage medium which stores a program which realizes the technique. Of course, the storage medium which stores the software may be a magnetic storage medium or a magneto-optical storage medium. Alternatively, any storage media which will be developed in the future can be similarly employed.

DESCRIPTION OF THE PREFERRED EMBODIMENT

An embodiment of the present invention will now be described.

(1) First Embodiment

(1-1) Configuration

Figure 1:
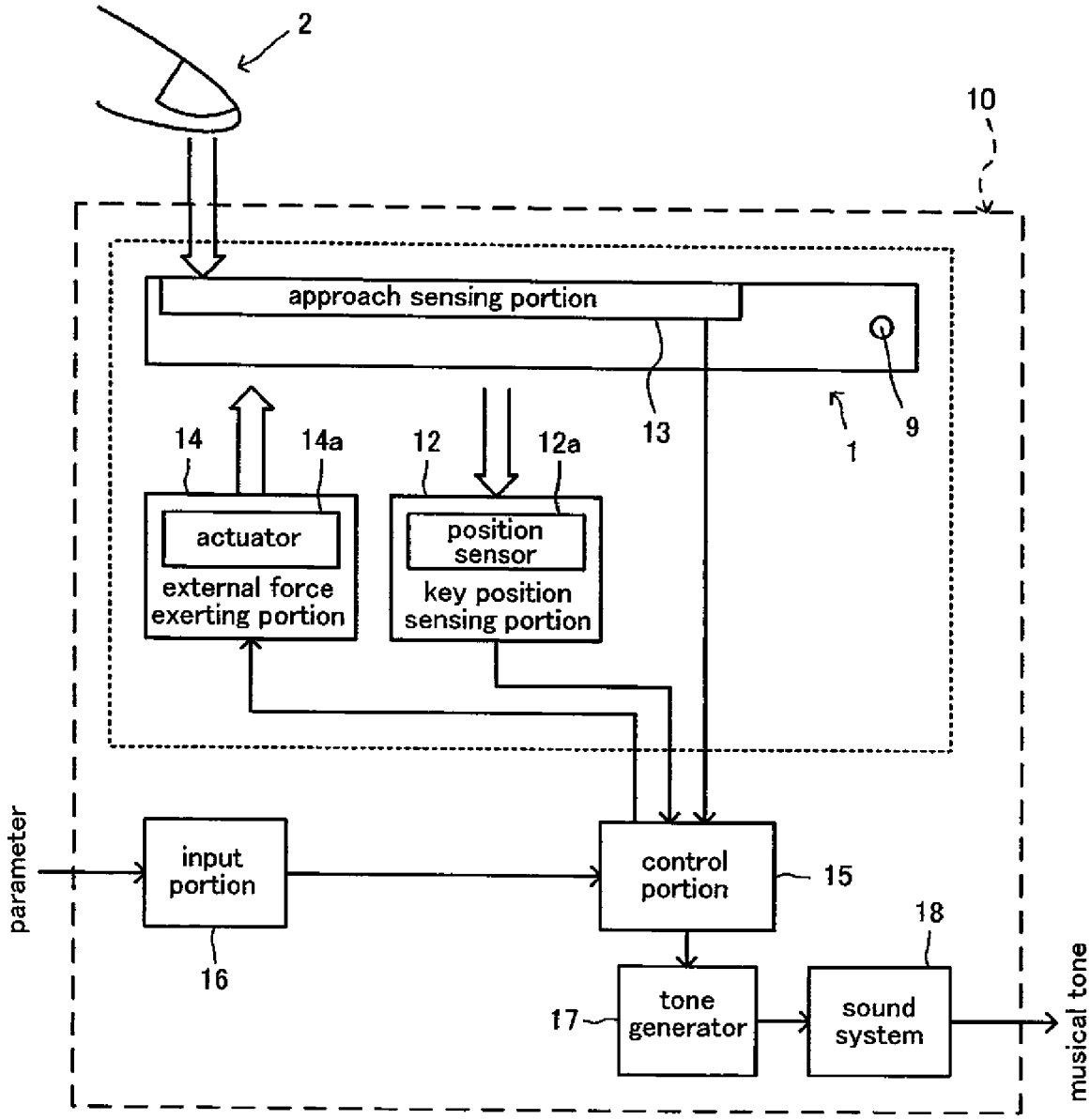
FIG. 1 is a block diagram showing an electronic piano according to a first embodiment.

FIG. 1 is a block diagram showing a configuration of an essential part of an electronic piano 10 used as a keyboard musical instrument according to the embodiment. The electronic piano 10 has a plurality of keys 1 which compose a keyboard. The electronic piano 10 also has an external force exerting portion 14, a key position sensing portion 12 and an approach sensing portion 13 for each of the keys 1. Further, the electronic piano 10 also has a control portion 15 which performs later-described control of external forces which will be exerted on the keys 1, a tone generator 17, a sound system 18 and an input portion 16. The respective approach sensing portions 13, the external force exerting portions 14, the key position sensing portions 12, the input portion 16 and the tone generator 17 transmit and receive various signals to and from the control portion 15 through an interface which is not shown.

Figure 2A:
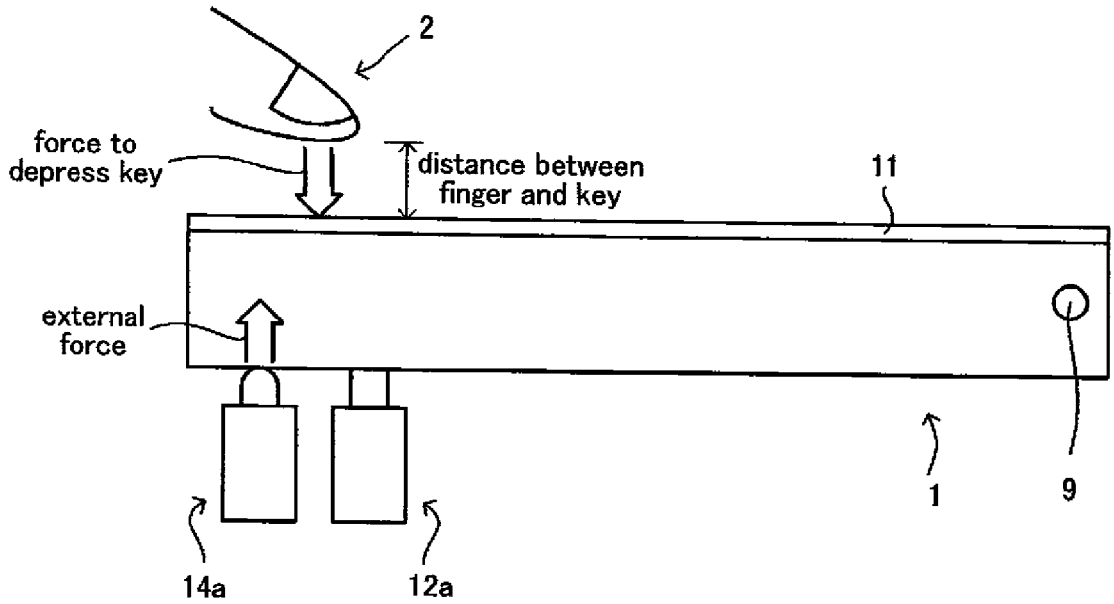
FIG. 2 is schematic drawings showing a key of the electronic piano according to the first embodiment.

Each of the external force exerting portions 14 has an actuator 14*a* and a driving circuit which causes the actuator 14*a* to exert on the key 1 an external force which resists a depression of the key. The exerting of an external force is done according to directions from the control portion 15. The driving circuit is not shown. As shown in FIG. 2A, the actuator 14*a* is provided under the key 1. The actuator 14*a* is composed of a solenoid, for example.

Figure 2B:
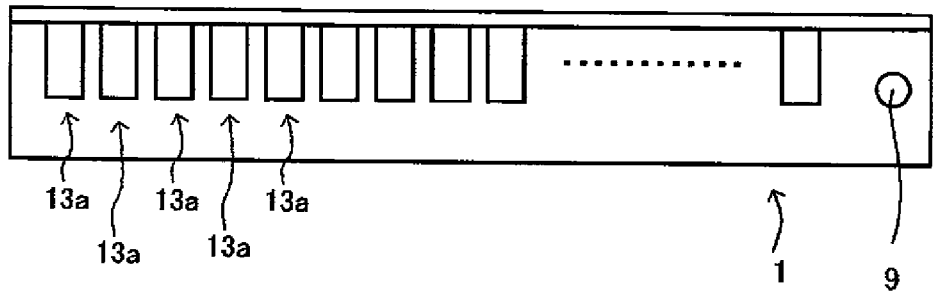
Figure 2C:
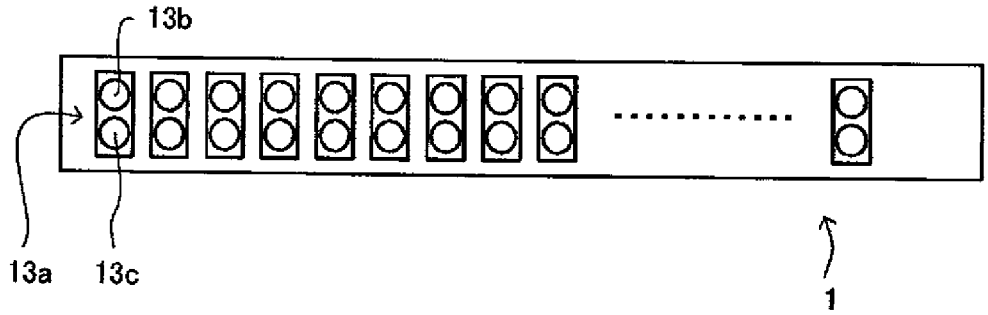

Each of the approach sensing portions 13 has a plurality of reflective photosensors 13*a* provided inside the key 1. FIG. 2B is a schematic cross-sectional view in which the key 1 is seen from a side. FIG. 2C is a schematic top view in which the key 1 is seen from above with a cover member 11 of the key 1 being removed. Each of the reflective photosensors 13*a* has an infrared light emitting portion 13*b* and an infrared light receiving portion 13*c* accommodated in a case. An object to be sensed reflects light emitted by the infrared light emitting portion 13*b*, so that a distance between a finger which is the object to be sensed and the key is derived from an amount of the reflected light which is received by the infrared light receiving portion 13*c*. From variations of the distance between the finger and the key, in addition, the approach sensing portion 13 also derives a velocity at which the finger approaches the key. The cover member 11, which is a white or black-tinted plastic plate made of polyethylene, polystyrene, polycarbonate or the like, allows infrared light to pass therethrough.

As shown in FIG. 2B and FIG. 2C, the reflective photosensors 13*a* are arranged in parallel with the surface of the key 1, the surface being to be depressed by a player. Because the player does not always depresses the same position of the key, the plurality of photosensors are arranged in order to sense an approach of a finger regardless of where the key is depressed. In a case where the plurality of sensors are not arranged in parallel with the surface of the key, it is preferable to provide the sensor within an area where the player is most likely to depress.

This embodiment describes a case where the approach sensing portion 13 senses approach velocity. However, the approach sensing portion 13 may output data indicative of a distance between a finger and a key, so that the control portion 15 derives approach velocity on the basis of the data. Because the velocity and the acceleration are derivable as long as a distance between a finger and a key is sensed, the manner in which the velocity and the acceleration are derived may be any desired manner.

Each of the key position sensing portions 12 has a position sensor 12*a*. FIG. 2A is a side view showing the key 1. The position sensor 12*a* is provided under the key 1 as shown in FIG. 2A. The position sensor 12*a* senses a position of the key which is varied by depression and release of the key, while the key position sensing portion 12 outputs data indicative of the position of the key. When a finger 2 depresses the key 1, the key 1 pivots about a pivot axis 9. The key position sensing portion 12 outputs data indicative of position of the key which varies according to the pivoting thereof. The velocity and acceleration of the depression of the key 1 may be derived on the basis of the output data indicative of the position of the key. In accordance with a direction in which the key 1 moves and the velocity of the move, furthermore, the timing of a depression or release of the key can be sensed. As the position sensor 12*a*, a plunger solenoid may be used to sense a position of the key in accordance with voltage varying according to moves of the plunger. As another example, the position of the key may be sensed in a manner in which light is applied in the vicinity of an edge of the plunger to sense the position of the key by using variations of the amount of light cut off by the plunger according to the move of the plunger.

The key position sensing portion 12, the approach sensing portion 13 and the external force exerting portion 14 are provided for each key. The control portion 15 has a CPU, a RAM, a ROM and the like to execute programs stored in the ROM and storage media which are not shown. In the storage media which are not shown, various kinds of parameters which will be described later are stored. The control portion 15 repeatedly scans data output by the key position sensing portions 12 of the respective keys to sense keys which fingers of the player are currently touching. In addition, the control portion 15 outputs data indicative of a pitch of a key whose depression has been sensed to the tone generator 17.

The tone generator 17 generates corresponding musical tone signals. The generated musical tone signals are transmitted to the sound system 18 composed of amplifiers and speakers which are not shown to emit musical tones. The input portion 16 is composed of dials and the like for inputting a player's selected key touch feeling. Up to this point the configuration of the electronic piano 10 has been described.

(1-2) External Force Control Process

Figure 3:
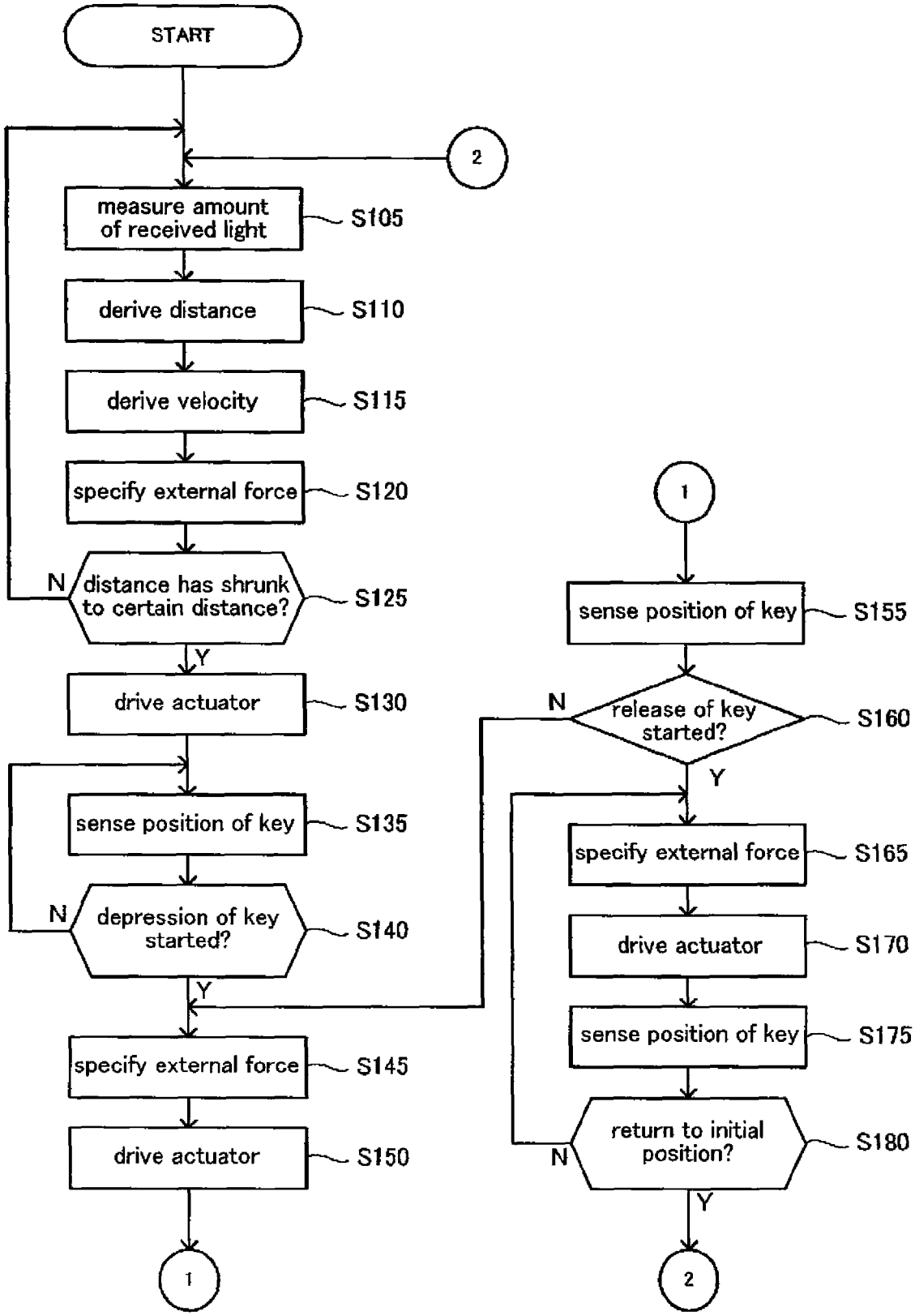
FIG. 3 is a flowchart showing an external force control process according to the first embodiment.

FIG. 3 is a flowchart showing an external force control process executed in this embodiment. This flowchart shows a process which starts prior to a depression of a key and continues until the key is released to return to its initial position. The control portion 15 sequentially changes a key which is to be controlled at certain time periods or at certain process steps, so that this process is carried out for every key. Various states of a key such as pre-depression, depression, and post-depression and various kinds of process data are stored in the RAM for each key.

First, the reflective photosensors 13*a* measure an amount of received light (step S105). More specifically, the infrared light emitting portions 13*b* starts emitting infrared light, while the infrared light receiving portions 13*c* starts receiving infrared light. An amount of the received light is measured at intervals of the order of 0.1 ms, for instance.

Figure 4A:
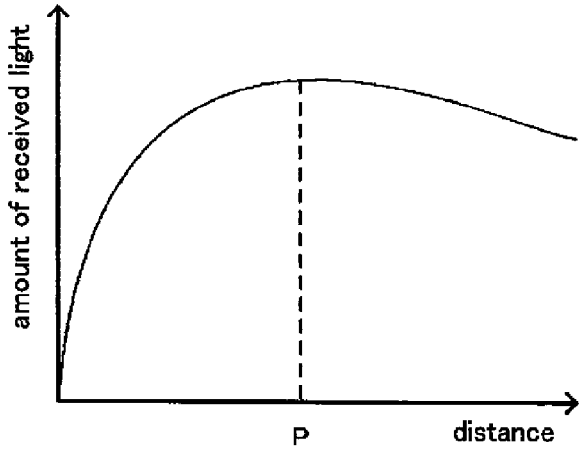
FIG. 4A is a graph showing properties of a sensor according to the first embodiment.
Figure 4B:
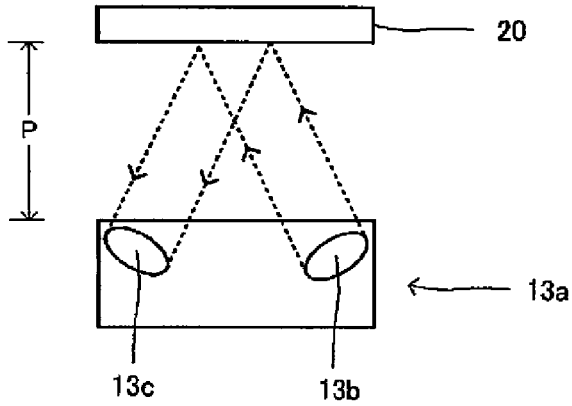
FIG. 4B and FIG. 4C are schematic diagrams showing the sensor and an object to be sensed according to the first embodiment.
Figure 4C:
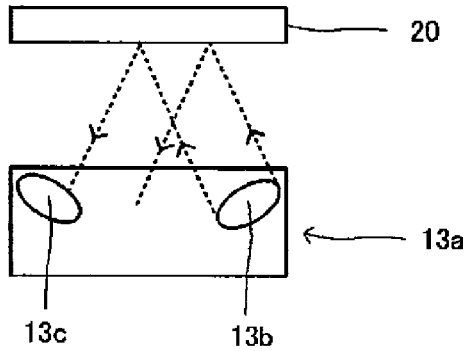

FIG. 4A, which is a graph showing properties of the reflective photosensors 13*a*, shows the relationship between a distance from an object to be sensed and an amount of received light. FIG. 4B shows a state in which a distance from an object 20 which is to be sensed is a distance P shown in FIG. 4A (a distance which obtains the largest amount of received light). The amount of received light decreases with increasing approach of the object 20 to the position P or with increasing distance of the object 20 from the position P. FIG. 4C shows a state in which the object 20 which is positioned nearer to the reflective photosensor 13*a* than the case of FIG. 4B results in displacement of the area where the reflected light is applied from the position of the infrared light receiving portion 13*c*. In step S110, the approach sensing portion 13 derives a distance between a finger and a key which is under process in accordance with the amount of received light.

In step S115, in accordance with varying amounts of derived distance the approach sensing portion 13 derives a velocity at which the finger approaches the key. In step S120, the control portion 15 specifies an external force to be exerted on the key in accordance with the velocity. In a case where the velocity vector moves away from the key in step S115, the process may return to step S105 without proceeding to step S120.

Figure 5A:
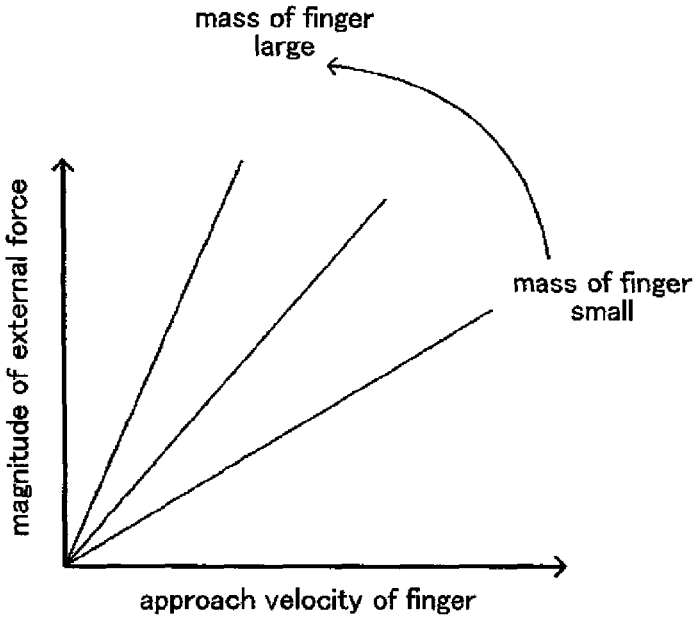
FIG. 5A is a graph showing the control of an external force to be exerted before a finger touches a key according to the first embodiment.

FIG. 5A is a graph showing the relationship between a derived approach velocity and the magnitude of an external force specified by the control portion 15 in accordance with the approach velocity. It is considered that the momentum to be imparted to a key depends on the momentum of a finger imparted just before the depression of the key. Assuming that the finger collides with the key at the derived approach velocity, therefore, the momentum of the collision at the depression of the key increases with increasing mass of the finger and increasing approach velocity of the finger. Therefore, the control portion 15 specifies the magnitude of an external force in accordance with the mass of the finger and the approach velocity. As shown in FIG. 5A, more specifically, the control portion 15 increases the magnitude of an external force with increasing approach velocity on condition that the fingers have the same mass. The control portion 15 increases the magnitude of an external force with increasing mass of a finger on condition that the fingers have the same approach velocity. The relationship between the magnitude of an external force and the approach velocity may not necessarily be linear as shown in FIG. 5A, but may be nonlinear.

The magnitude of an external force to be exerted on a key can be considered as a physical quantity which has a correlation between the approach velocity of a finger and the mass of the finger. In accordance with the physical quantity, therefore, the control portion 15 may specify the magnitude of an external force to be exerted on a key. Examples of the physical quantity having a correlation between the approach velocity of a finger and the mass of the finger include momentum, impulse, force and kinetic energy. As the physical quantity equivalent to the mass of a finger, a predetermined value may be used. In addition, the magnitude of an external force to be specified by the control portion 15 may vary according to the kind of a key or the pitch of the key. For example, an external force to be exerted on a black key may be smaller than an external force to be exerted on its neighboring white keys. For instance, in addition, external forces to be exerted on treble keys may be smaller than external forces to be exerted on bass keys. The magnitude of an external force may vary from pitch to pitch. For example, the magnitude of an external force may vary among octaves.

In the storage media which are not shown, parameters for specifying the magnitude of an external force corresponding to the approach velocity and the mass of a finger are previously stored. Update and addition of the values of the parameters may be allowed even after shipment from factory. Concrete values of the parameters may be freely specified. It is difficult to sense the mass of a finger before the finger touches a key. In this embodiment, therefore, the input portion 16 is provided in order to realize a key touch feeling desired by each player. More specifically, the input portion 16 has an interface for allowing a player or a user to choose his desired key touch. For example, the input portion 16 has a dial which allows the player or user to choose his desired degree of key touch feeling from among a few levels from "heavy" to "light". In this example, in a case where a child plays the electronic piano 10, the player can choose "light", while in a case where an adult plays the electronic piano 10, the player can choose "heavy". As described above, this embodiment is allowed to specify the magnitude of external forces, so that the player or user is allowed to make subtle adjustments to realize the touch of an acoustic piano.

In step S125, the control portion 15 determines whether the distance between the finger and the key has shrunk to a certain distance or less. The certain distance is a distance of the order of 1 mm, for example. If it is determined within a certain time period that the distance between the finger and the key has not shrunk to the certain distance or less, the process returns to step S105. If it is determined that the distance has shrunk to the certain distance or less, the control portion 15 controls the external force exerting portion 14 to allow the actuator 14*a* to generate an external force (step S130). By preventing the actuator 14*a* from generating an external force before the distance between the finger and the key shrinks to the certain distance or less, this embodiment saves power consumption compared to a case where an external force is generated even in a state where a distance between a finger and a key is the certain distance or more. A stopper may be provided for the keys 1 in order to prevent the key 1 from rising upward from the initial position.

In step S135, the key position sensing portion 12 senses a position of the key by use of the position sensor 12*a*. In step S140, the control portion 15 determines on the basis of data output by the key position sensing portion 12 whether a depression of the key 1 has been started. If it is not determined within a certain time period that a depression of the key 1 has been started, the exerted external force may be removed to return to step S105, for example. As described above, by deriving a velocity at which a finger of a player approaches a key, and exerting an external force on the key in accordance with the velocity before the finger of the player touches the key, this embodiment allows the player to feel a resistance which correlates with the momentum of the depression of the key as soon as the player depresses the key. In other words, this embodiment allows the player to obtain the key touch feeling close to that of an acoustic piano as soon as the player depresses the keys of this keyboard musical instrument.

Figure 5B:
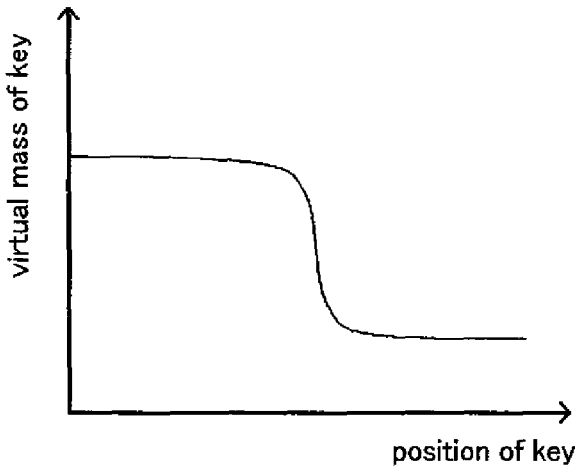
FIG. 5B is a graph showing the control of an external force to be exerted after the finger has touched the key.

As the control of an external force to be exerted after the start of a depression of a key, a conventionally known art can be employed such as a method disclosed in Japanese Patent Publication No. 3191327. What is disclosed in Japanese Patent Publication No. 3191327 is incorporated in this specification. More specifically, the magnitude of an external force to be generated by the actuator 14*a* is designed-such that the relationship between a virtual mass of a key and a position of the key varies as shown in FIG. 5B. FIG. 5B shows that the touch of a key becomes light at the time when the key is depressed to reach a certain position, which recreates the touch of keys of an acoustic piano.

In order to realize the above-described touch, the control portion 15 specifies the magnitude of an external force in accordance with the sensed position of the key (step S145), and controls the external force exerting portion 14 to allow the actuator 14*a* to generate the external force (step S150). Then, the key position sensing portion 12 senses the position of the key (step S155), while the control portion 15 determines whether the finger has started leaving the key (step S160). Until the start of the release of the key, steps from S145 to S155 are repeated. Furthermore, it is preferable to adjust the external force to be specified before the finger touches the key in accordance with the approach velocity and the external force to be specified after the finger touches the key on the basis of the position of the key so that a significant degree of discontinuity that can make the player feel strange will not arise between the external forces.

In step S165, the control portion 15 specifies an external force on the basis of the position of the key. In step S170, the control portion 15 controls the external force exerting portion 14 to allow the actuator 14*a* to generate the external force. In step S175, the key position sensing portion 12 senses a position of the key. In step S180, the control portion 15 determines whether the key has returned to its initial position. If it is determined that the key has returned to the initial position, the process returns to step S105.

(2) Second Embodiment

What is different about a second embodiment from other embodiments is the configuration of the approach sensing portion 13. The second embodiment employs a configuration which uses a capacitance sensor for sensing a velocity of a finger. The capacitance sensor is provided on the surface of a key. The capacitance sensor may be provided inside or under the key.

Figure 6A:
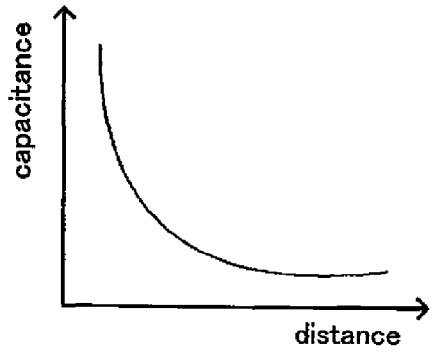
FIG. 6A is a graph showing properties of a sensor according to a second embodiment.

FIG. 6A, which is a graph showing properties of the capacitance sensor, indicates the relationship between capacitance and distance. The distance indicates a distance between a probe of the capacitance sensor and an object to be sensed. The distance and the capacitance are in inverse proportion. The approach sensing portion 13 derives a distance between the probe and a finger considered as the object to be sensed in accordance with a capacitance output by the capacitance sensor. The approach sensing portion 13 may derive an approach velocity of the finger in accordance with variations of the distance between the probe and the finger. The number of sensors provided for a key may be either one or more. In a case where a sensor which covers an area as large as possible in a range of the surface of the key where a player is supposed to depress is employed as the probe of the capacitance sensor, the number of the sensors may be one.

(3) Other Embodiments

As means for sensing approach, not only the configurations of the above-described embodiments but also those described below may be employed. A sensor of the approach sensing means may be provided either for each key or for a plurality of keys according to method of sensing or type of undulations to sense.

Reflective Photosensor

In the above-described embodiment, the reflective photosensor is provided inside the key. However, the reflective photosensor is not necessarily provided inside the key. Either the light emitting portion or the light receiving portion may be provided outside the key. Alternatively, both the light emitting portion and the light receiving portion may be provided outside the key. More specifically, the reflective photosensor is acceptable as long as an area within which a finger moves to depress the key is included in a path along which light runs from the light emitting portion, and the light receiving portion is placed in a position where the light receiving portion can receive light reflected from the finger.

Separated Photosensor

Figure 6B:
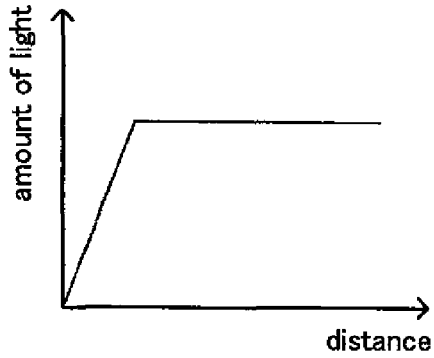
FIG. 6B to FIG. 6D are graphs showing properties of sensors according to other embodiments.
Figure 7:
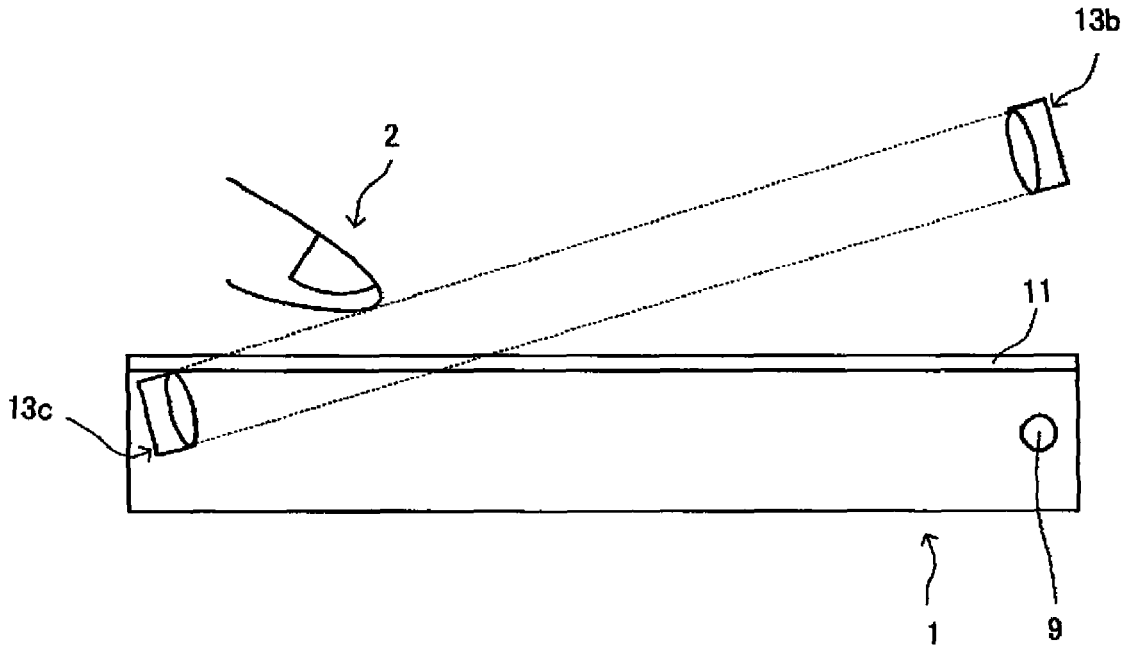
FIG. 7 is a schematic diagram showing a key of the electronic piano according to other embodiment.

FIG. 7 is a schematic diagram showing a configuration which employs a separated photosensor. In FIG. 7, elements similarly employed in the first embodiment are numbered similarly to the first embodiment. In FIG. 7, the infrared light emitting portion 13*b* is placed outside the key 1, while the infrared light receiving portion 13*c* is placed inside the key 1. The infrared light emitting portion 13*b* and the infrared light receiving portion 13*c* are arranged such that the respective optical axes of the infrared light emitting portion 13*b* and the infrared light receiving portion 13*c* are aligned. FIG. 6B is a graph showing the relationship between a distance to an object to be sensed and an amount of light received by the infrared light receiving portion 13*c*. If the finger 2 is placed within a range in which light is applied by the infrared light emitting portion 13*b*, the infrared light emitted by the infrared light emitting portion 13*b* is cut off by the finger 2, so that an amount of light received by the infrared light receiving portion 13*c* decreases with increasing approach of the finger 2 to the key 1 as shown in FIG. 6B. As described above, the separated photosensor may be used to derive an approach velocity of a finger.

Thermal Sensor

Figure 6C:
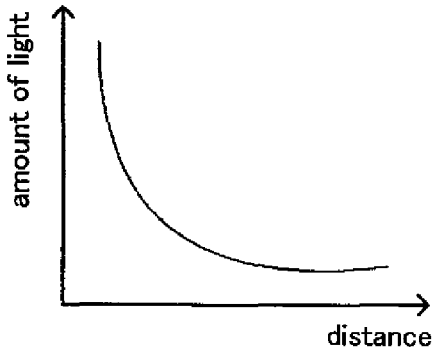

A pyroelectric infrared sensor which is a kind of thermal sensors is a sensor for sensing weak infrared radiation emitted by a human body. FIG. 6C is a graph showing the relationship between a distance between an object to be sensed by the pyroelectric infrared sensor and the pyroelectric infrared sensor and an amount of infrared radiation. As shown in FIG. 6C, an amount of sensed infrared radiation increases with decreasing distance from the object. As described above, the pyroelectric infrared sensor may be used to derive an approach velocity of a finger, the pyroelectric infrared sensor being placed inside a key or on the surface of the key so that the pyroelectric infrared sensor is exposed at the surface.

Doppler Sensor

Figure 6D:
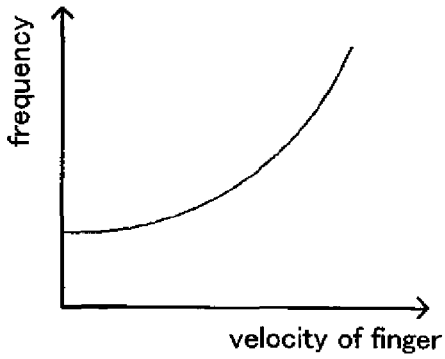

A microwave Doppler sensor which is a kind of Doppler sensors is a sensor for sensing, by use of the Doppler effect, a velocity at which an object moves or a distance to the moving object. The sensor has a microwave emitting portion and a microwave receiving portion. A frequency of a microwave emitted by the emitting portion is different from a frequency of microwave reflected by a moving object and then received by the receiving portion. FIG. 6D is a graph showing the relationship between a velocity of a finger which is considered as a moving object and a received frequency (the vector of velocity in a direction in which the finger approaches the key is considered as positive). Compared to the frequency emitted by the emitting portion, the frequency received by the receiving portion increases with increasing velocity at which the finger approaches the key. As described above, the Doppler sensor may be used to derive an approach velocity of a finger and a distance between a finger and a key, the Doppler sensor being placed on the surface of a key or inside a key, for example.

Image Sensor

A distance image sensor which is a kind of image sensors is a sensor for measuring, for each pixel, the time taken for the light radiated by the sensor to reflect to return and then outputting a distance to an object so that pixel-to-pixel identification is allowed. The distance image sensor is placed at a position from which a finger approaching a key can be shot. A distance between a finger which is to be sensed and a key and an approach velocity of the finger may be derived by analyzing image data output by the distance image sensor at certain time intervals to compare the analyzed results among frames. The distance image sensor may be provided for every few keys. This case can reduce the number of parts which compose the embodiment, compared to a case where the distance image sensor is provided for each key.

The present invention is not limited to the above-described embodiments, but various modifications can be made without departing from the scope of the present invention.

What is claimed is:

1. A keyboard musical instrument comprising:

a key for conducting an operation for playing music;

an approach sensing portion for sensing an approach of a finger of a player to the key based on a distance between the finger and the key;

an external force exerting portion for exerting, on the key, an external force which resists a depression of the key; and a controlling portion for allowing the external force exerting portion to exert the external force on the key based on a result of sensing by the approach sensing portion before the finger whose approach has been sensed touches the key, wherein the approach sensing portion senses a velocity at which the finger of the player approaches the key, and the controlling portion allows the external force exerting portion to exert the external force specified in accordance with the velocity.

2. A keyboard musical instrument according to claim 1, wherein the approach sensing portion has a reflective electromagnetic wave sensor to sense a distance between the finger and the key in accordance with electromagnetic wave reflected by the finger of the player to derive the velocity in accordance with time variations of the distance.

3. A keyboard musical instrument according to claim 2, wherein the plurality of reflective electromagnetic wave sensors are provided inside the key to be arranged in parallel with the surface of the key, the surface being to be depressed.

4. A keyboard musical instrument according to claim 1, wherein the approach sensing portion has a reflective photosensor to sense a distance between the finger and the key in accordance with light reflected by the finger of the player to derive the velocity in accordance with time variations of the distance.

5. A keyboard musical instrument according to claim 4, wherein the plurality of reflective photosensors are provided inside the key to be arranged in parallel with a surface of the key, the surface being to be depressed.

6. A keyboard musical instrument according to claim 1, wherein the approach sensing portion has a capacitance sensor on a surface of the key to sense a distance between the finger of the player and the key in accordance with a capacitance between the finger and a probe of the capacitance sensor to derive the velocity in accordance with time variations of the distance.

7. A keyboard musical instrument according to claim 1, wherein the approach sensing portion has a separate photosensor to sense a distance between the finger and the key in accordance with light cut off by the finger of the player to derive the velocity in accordance with time variations of the distance.

8. A keyboard musical instrument according to claim 1, wherein the approach sensing portion has a thermal sensor to sense a distance between the finger and the key to derive the velocity in accordance with time variations of the distance.

9. A keyboard musical instrument according to claim 1, wherein the approach sensing portion has a Doppler sensor to sense the velocity.

10. A keyboard musical instrument according to claim 1, wherein the approach sensing portion has an image sensor to sense the velocity.

11. A keyboard musical instrument according to claim 1, wherein the magnitude of the external force specified in accordance with the velocity increases with increasing mass of the finger of the player.

12. A keyboard musical instrument according to claim 11 further comprising:

an inputting portion for inputting a parameter corresponding to the mass of the finger.

13. A keyboard musical instrument according to claim 1, wherein the controlling portion allows the external force exerting portion to exert the external force if a distance between the finger of the player and the key is a certain distance or less.

14. A keyboard musical instrument according to claim 1, wherein the controlling portion allows the external force exerting portion to exert on the key, after the finger of the player has touched the key, the external force specified in accordance with a position of the key.

* * * * *